US007240898B2

(12) United States Patent
Takamura et al.

(10) Patent No.: US 7,240,898 B2
(45) Date of Patent: Jul. 10, 2007

(54) POST-PROCESSING DEVICE AND POST-PROCESSING METHOD

(75) Inventors: Mitsuhide Takamura, Mishima (JP); Masaki Otake, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 11/016,860

(22) Filed: Dec. 21, 2004

(65) Prior Publication Data

US 2005/0140077 A1 Jun. 30, 2005

(30) Foreign Application Priority Data

Dec. 26, 2003 (JP) ..... 2003-435941
Nov. 17, 2004 (JP) ..... 2004-333299

(51) Int. Cl.
*B65H 33/00* (2006.01)

(52) U.S. Cl. ..... 270/58.09; 270/58.01; 270/58.07; 270/58.08

(58) Field of Classification Search ..... 270/58.01, 270/58.07, 58.08, 58.09
See application file for complete search history.

(56) References Cited

U.S. PATENT DOCUMENTS 5,730,438 A * 3/1998 Webb et al. ..... 270/58.08
6,305,681 B1 * 10/2001 Watanabe et al. ..... 270/58.08
2004/0084827 A1 5/2004 Takamura ..... 270/58.08

FOREIGN PATENT DOCUMENTS

JP 08129287 A * 5/1996
JP 2000-321940 11/2000

* cited by examiner

*Primary Examiner*—Gene O. Crawford
*Assistant Examiner*—Leslie A. Nicholson, III
(74) *Attorney, Agent, or Firm*—Fitzpatrick, Cella, Harper & Scinto

(57) ABSTRACT

The state of post-processing operation is detected, and a drive signal is limited based on the result of detection for a predetermined period after the start of the post-processing operation (for instance by setting an upper limitation to the driving current and thereby limiting and reducing the peak value).

19 Claims, 13 Drawing Sheets

POST-PROCESSING DEVICE AND POST-PROCESSING METHOD

BACKGROUND OF THE INVENTION

1. Field of the Invention

The present invention relates to a post-processing device and a post-processing method which are able to perform post-processing control and control processing of drive signals at the time of driving in a stapler, puncher or the like to be connected to an image formation (recording) device.

2. Description of the Related Art

A conventional image formation device such as a printer or a copying machine has a post-processing device. In the post-processing device, the edges between sheets on which images are formed (which are printed) are registered and post-processing including stapling and punching is performed, and thus the post-processed sheets are discharged and are stocked. Such a post-processing device is provided beside or above the sheet outlet of the body of an image formation device, and the post-processing device has a registration structure that sheets printed by the image formation device are supplied successively from its outlet to perform post-processing. A device, which is known as the post-processing device, has a finishing function that the sheets are registered in the direction (lengthwise direction) parallel to the feeding direction of the sheets as well as in the direction (widthwise direction) vertical to the same feeding direction, and thus the registered sheets are subjected to post-processing such as stapling and are discharged from the device.

As other known post-processing devices, a device has only a stacking function that sheets printed by the image formation device are stacked in sequence on a discharge tray without post-processing, and a device has a function that post-processing based on the above finishing function and mounting-processing based on the stacking function.

(1) For instance, a finisher as a staple post-processing device has a function that the registered sheets are discharged to a stacking tray and are stacked on the tray.

However, a rush current flowed to the stapler is large when the stapler is driven at the time of stapling, which is a way of post-processing the printed sheets, and the driving current of the stapler increases depending on the type and number of sheets to be stapled, thus imposing, a heavy burden on a power source connected to the post-processing device.

(2) A staple post-processing device, which operates by being connected to an image formation device, has a driving power supplied from the image processing device or a power source included in the staple device.

However, where power is supplied from the image formation device to the post-processing device and power is also supplied to any other connected device or unit (for instance, an optional paper feed device, a scanner for reading the subject copy or the like) from the image formation device, an increase in current at the time of operating each of these devices results in a greater power supply capacity and a higher cost. When the operational timing is overlapped between devices, a current is increased largely and temporarily though for a short period of time.

(3) In an image formation device according to the prior art described in the Japanese Patent Application Laid-Open No. 2000-321940 for instance, the control for changing the timing of operation is performed so that peak current occurred between the connected devices is not overlapped each other, thus reducing the peak current and the average current of the whole image formation device.

However, according to the Japanese Patent Application Laid-Open No. 2000-321940, when a plurality of consecutive printing jobs are performed, the control for changing the actuation timings of the plurality of devices connected to the image formation device is necessary, and the complication of the control method and a throughput as the image formation device overall may be induced. The peak value of current consumption differs according to the type of the optional connectable devices, and the control for changing the operational timing may be complicated according to the form of connection.

(4) Another problem is that, when sheaves of sheets are to be post-processed, post-processing by stapling, punching or otherwise may induce a loud noise due to an increased driving power of the operation members. When a plurality of post-processing is to be performed at the same time, the noise of device at operation as well as the aforementioned increased power may induce a big problem.

SUMMARY OF THE INVENTION

An object of the present invention, in view of the problems noted above, is to provide a post-processing device and post-processing method which can reduce the peak value of a drive signal (e.g. a driving current) and reduce the load on a power source.

That is, the operation situation of post-processing operation is detected, and the drive signal is limited during a predetermined period based on the result of detection after the start of post-processing operation (for example, an upper limitation is set to the driving current and the peak value is limited to reduce a peak level).

Another object of the invention is to provide a post-processing device and a control method which can reduce the peak level of the drive signal according to the state of the post-processing unit by setting the duration of the limitation of the peak level of the drive signal at the time of post-processing operation in a plurality of divided periods.

Still another object of the invention is to provide a post-processing device and a control method which can reduce the operating noise of post-processing action members by reducing the operating speed of the post-processing unit.

According to the invention, there is provide a post-processing device comprising sheet conveying means for carrying sheets outputted from an image formation device into the main body of the device; post-processing means for subjecting a plurality of sheets carried into said main body to post-processing as a sheet bundle; drive signal limitation means for limiting, on the basis of the operating state of post-processing operation by said post-processing means, the magnitude of a drive signal for driving said post-processing means during a predetermined period after the start of the post-processing operation; and sheet bundle loading means for loading the post-processed sheet bundle.

According to the invention, there is also provided a post-processing method comprising a sheet conveying step of carrying sheets outputted from an image formation device into the main body of the device; a post-processing step of subjecting a plurality of sheets carried into said main body to post-processing as a sheet bundle; a drive signal limitation step of limiting, on the basis of the operating state of post-processing operation by said post-processing means, the magnitude of a drive signal for driving said post-processing means during a predetermined period after the start of the post-processing operation; and a sheet bundle loading step of loading the post-processed sheet bundle.

According to the invention, there is further provided an image formation system provided with an electro photographic image formation device is featured in that the post-processing device according to claim 1 is connected to a stage following said image formation device.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described in detail below with reference to drawings.

EXAMPLE 1

A first preferred embodiment of the present invention will be described with reference to FIGS. 1 to 8.

(Device Configuration)

In an image formation system provided with the image formation device, which typically is a laser beam printer, an example of the configuration of a post-processing device to be fitted to an image formation device will be explained.

Figure 1:
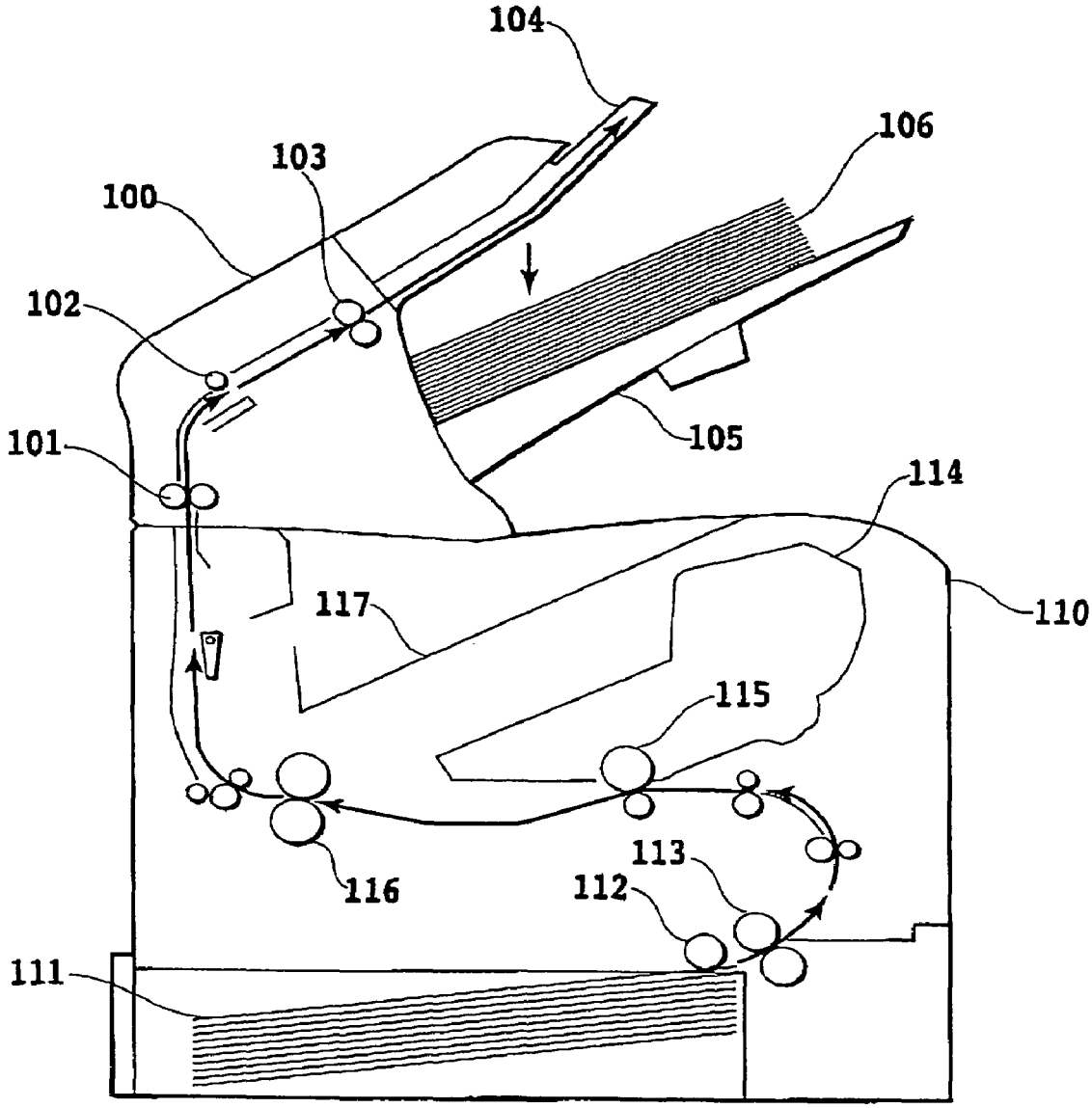
FIG. 1 is a sectional view showing an example of a configuration of an image formation system consisting of an image formation device and a post-processing device as a first embodiment according to the present invention.

FIG. 1 shows the image formation device and the carriage path structure of a post-processing device (staple stacker) having a staple post-processing function.

A reference numeral 100 denotes a post-processing device installed over an image formation device 110. This post-processing device 100 consists of a stapler 316 (see FIGS. 2A, 2B and FIG. 3) that mounts a sheet bundle and registers the sheet bundle, and staples the registered sheet bundle. The device 100 consists of a staple stacker having a stacker function to be loaded with and discharges the sheet bundle.

A numeral 101 denotes an inlet roller which first receives a sheet carried from the image formation device 110. A reference numerical 102 denotes a carrier roller which carries the sheet within the post-processing device 100. A reference numerical 103 denotes an outlet roller arranged at the outlet within the post-processing device 100.

A reference numeral 104 denotes registration member that registers the sheet at a right angle to (along the width of sheets) the carrying direction of the sheet bundle loaded within the post-processing device 100.

A reference numeral 105 denotes a discharge tray to be loaded with discharged sheets.

A reference numeral 106 denotes a sheet discharged and loaded.

A reference numeral 111 denotes a sheet bundle loaded within the image formation device 110 before being fed.

The sheet bundle 111 is separated and fed by a pickup roller 112 and a pair of feed retard rollers 113. Then, a toner image is formed on a top face of the sheet 106 fed out of the sheet bundle 111 in a forming process by an electronic photograph processing unit 115 having a toner cartridge 114, and fixation of the formed image of the sheet 106 is fixed in a fixing process by a fixing unit 116. Then, the sheet 106 is either discharged onto a discharge tray 117 of the image formation device 110 or carried to the post-processing device 100 to perform post-processing.

The sheet 106 carried into the post-processing device 100 are processed according to whether or not staple post-processing is required. If it is required, the sheet 106 is registered in the registration member 104. After being post-processed, the sheet 106 is discharged into the discharge tray 105 in sequence.

Figure 2A:
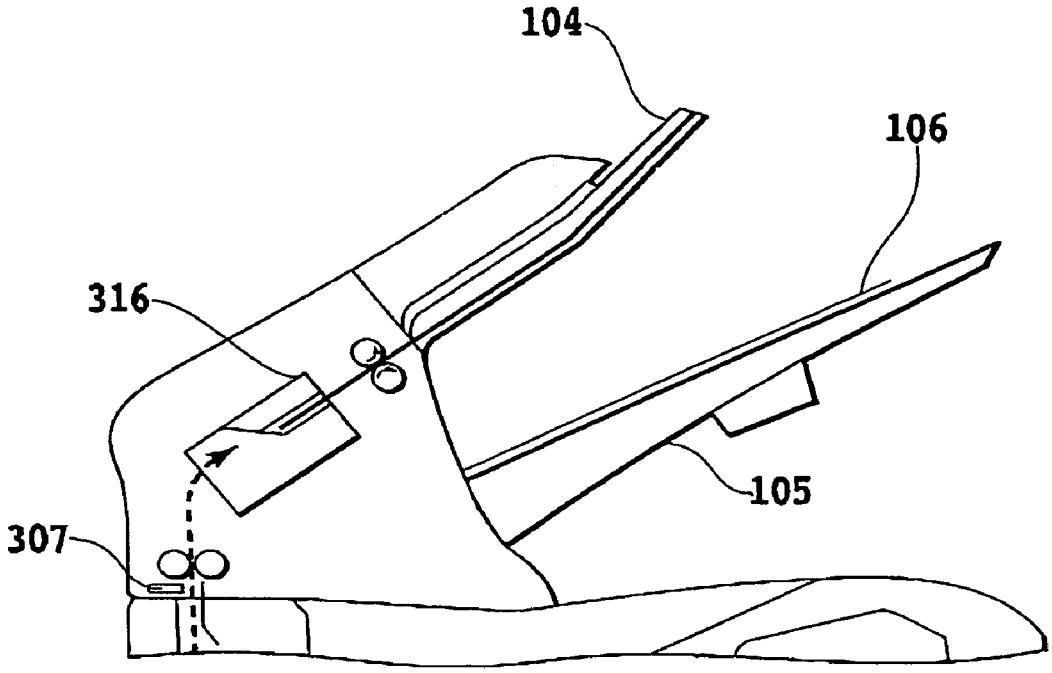
FIG. 2A is a sectional view of the post-processing device.
Figure 2B:
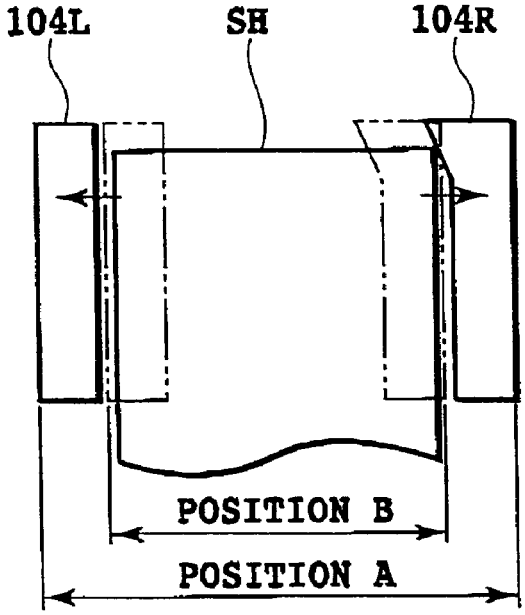
FIG. 2B is an upper plane view of the post-processing unit.

FIG. 2A and FIG. 2B are schematic views for explaining a registration process and a stocking process when the post-processing device 100 post-processes the sheets 106 by the stapler 316. Concretely, the explanation is that how the sheets 106 are registered between the carrying direction and the width direction normal thereto, and how the sheets 106 are stacked on the discharge tray 105.

The sheets 106 are carried from the image formation device 110 to the post-processing device 100, and are stacked in the registration members 104. Thus, the sheets 106 are registered by the left and right lining-up members 104L and 104R, and are held as the sheet bundle 111. After holding and registering a predetermined number of sheets 106, the post-processing device 100 performs staple processing to bind the sheets 106 near their rear ends with the stapler 316.

After that, the left and right registration members 104L and 104R movie from position B to position A, and operate so as to stack the sheets 106 onto the discharge tray 105. That is, the inner ends of the left and right lining-up members 104L and 104R expand wider than the width of the sheets 106 at position A, and thus the sheet bundle of the post-processed sheets 106 drops onto the discharge tray 105.

Figure 3:
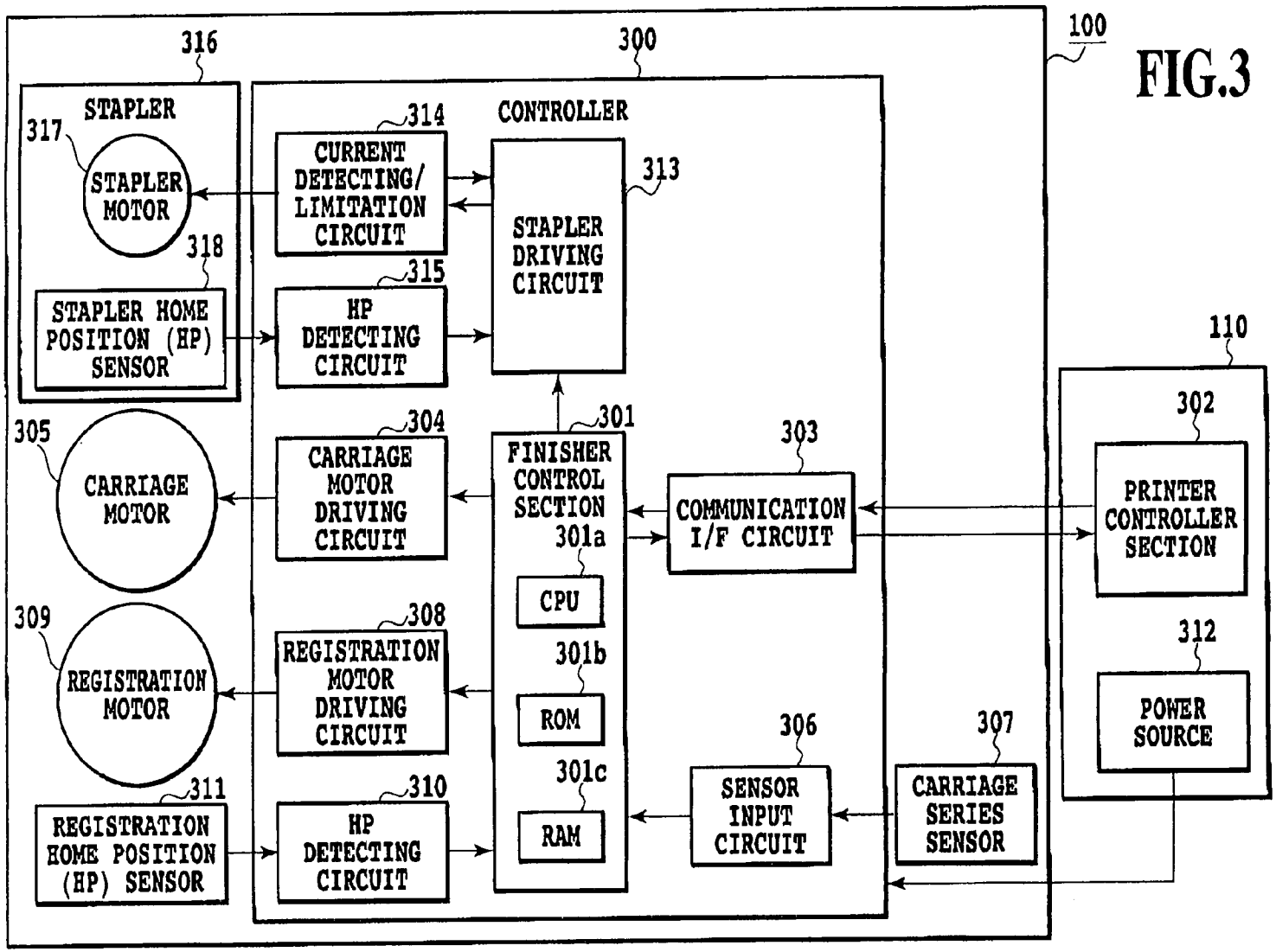
FIG. 3 is a block diagram showing the configuration of an electrical circuit of the post-processing device.

FIG. 3 is a block diagram the post-processing device 100.

A reference numeral 300 denotes a controller, which is hardware to control the post-processing device 100, and over which a finisher control section 301 and various hardware circuits are packaged.

The finisher control section 301 can transmit and receive information and operational timings pertaining to post-processing operations due to data communication from the printer control section 302 of the image formation device 110 via a communication I/F circuit 303.

The finisher control section 301 is configured of a central processing unit CPU 301*a*, a nonvolatile memory ROM 301*b* which memorizes programs in which control procedures are stored, and a volatile memory RAM 301*c* which temporarily holds data when a program is to be executed.

However, storing and execution of a program and holding of data are not necessarily confined to this configuration, but some other storage medium or memory may be used as well.

A carriage motor driving circuit 304 controls the carriage of sheets by driving a carriage motor 305.

A reference numeral 306 denotes a sensor input circuit which detects a sheet detection signal concerning sheet carriage which is outputted from a carriage series sensor 307 and the detected signal is inputted to the finisher control section 301.

A reference numeral 308 denotes a registration motor driving circuit for driving a registration motor 309 for driving the registration members 104 of FIG. 2A.

A reference numeral 310 denotes an HP detecting circuit for detecting a signal which is outputted from a registration home position (HP) sensor 311, and the detected signal shows the presence or absence at the home position (HP).

A reference numeral 312 denotes a power supply source provided in the image formation device 110, which supplies electric power to both the image formation device 110 and the post-processing device. The power source 312 supplies power to the controller 300 and supplies a current to each actuator connected to the controller 300.

A reference numeral 313 denotes a stapler driving circuit which drives the stapler unit 316 and sets current limitation to a level not higher than a current value detected by a current detecting/limiting circuit 314 and a level set by the finisher control section 301.

A reference numeral 315 denotes a circuit which detects the state of a stapler home position (i.e. stapler HP) sensor 318 according to the reference position of the driving member (not shown) of the stapler unit 316 when the stapler unit 316 is driven by a stapler motor 317. A signal showing the state of the stapler HP sensor 318 is outputted to the stapler driving circuit 313 and the outputted signal is used for setting current limitation.

Figure 4:
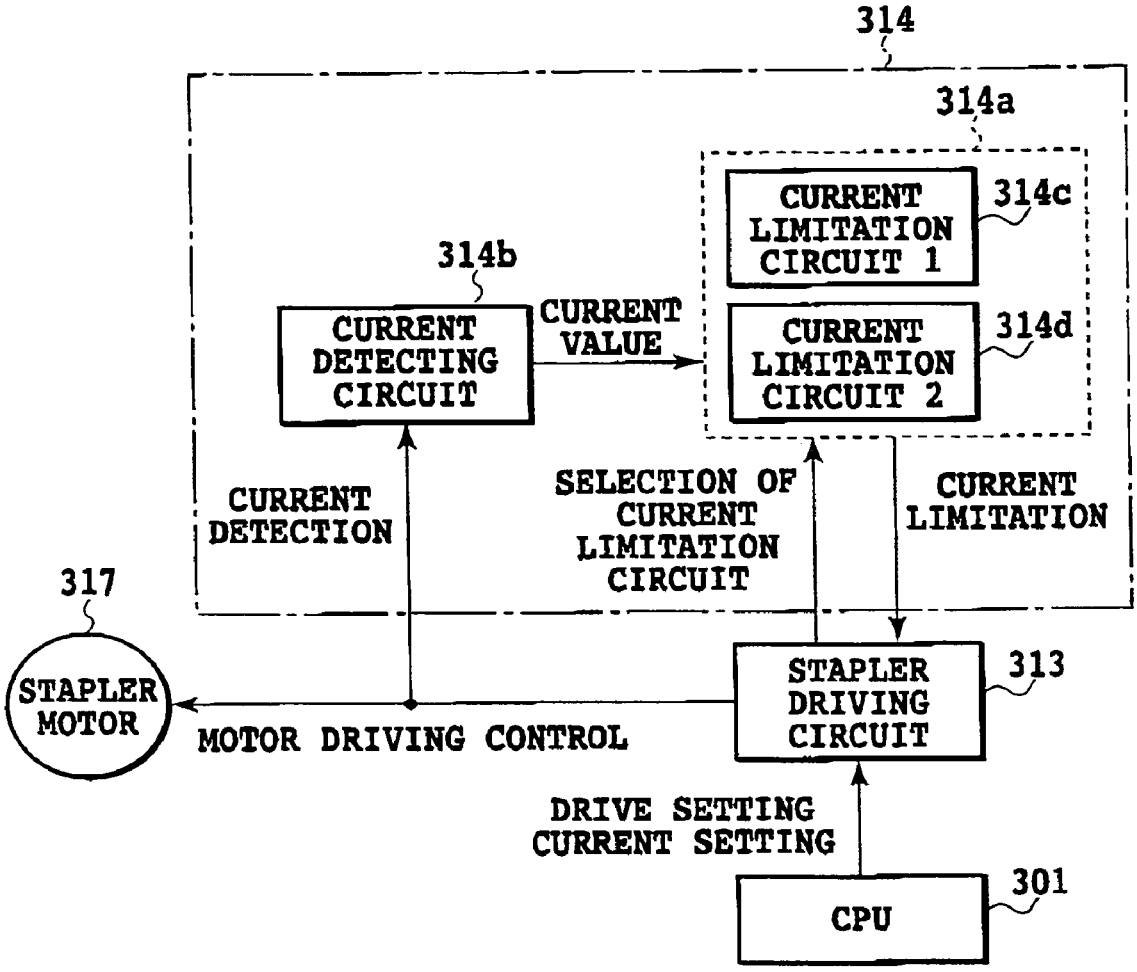
FIG. 4 is a block diagram showing the configuration of a current detecting/limiting circuit of the post-processing device.

FIG. 4 shows the configuration of the current detecting/limitation circuit 314.

This current detecting/limitation circuit 314 consists of a current limitation circuit 314*a* and a current detecting circuit 314*b*. The current limitation circuit 314*a* consists of a current limitation circuit 314*c* and a current limitation circuit 314*d*.

(Operation)

Next, the operation of this device will be described.

As an example of setting the upper limit of drive signals in staple processing, current limitation for the driving current is set as follows.

Figure 5:
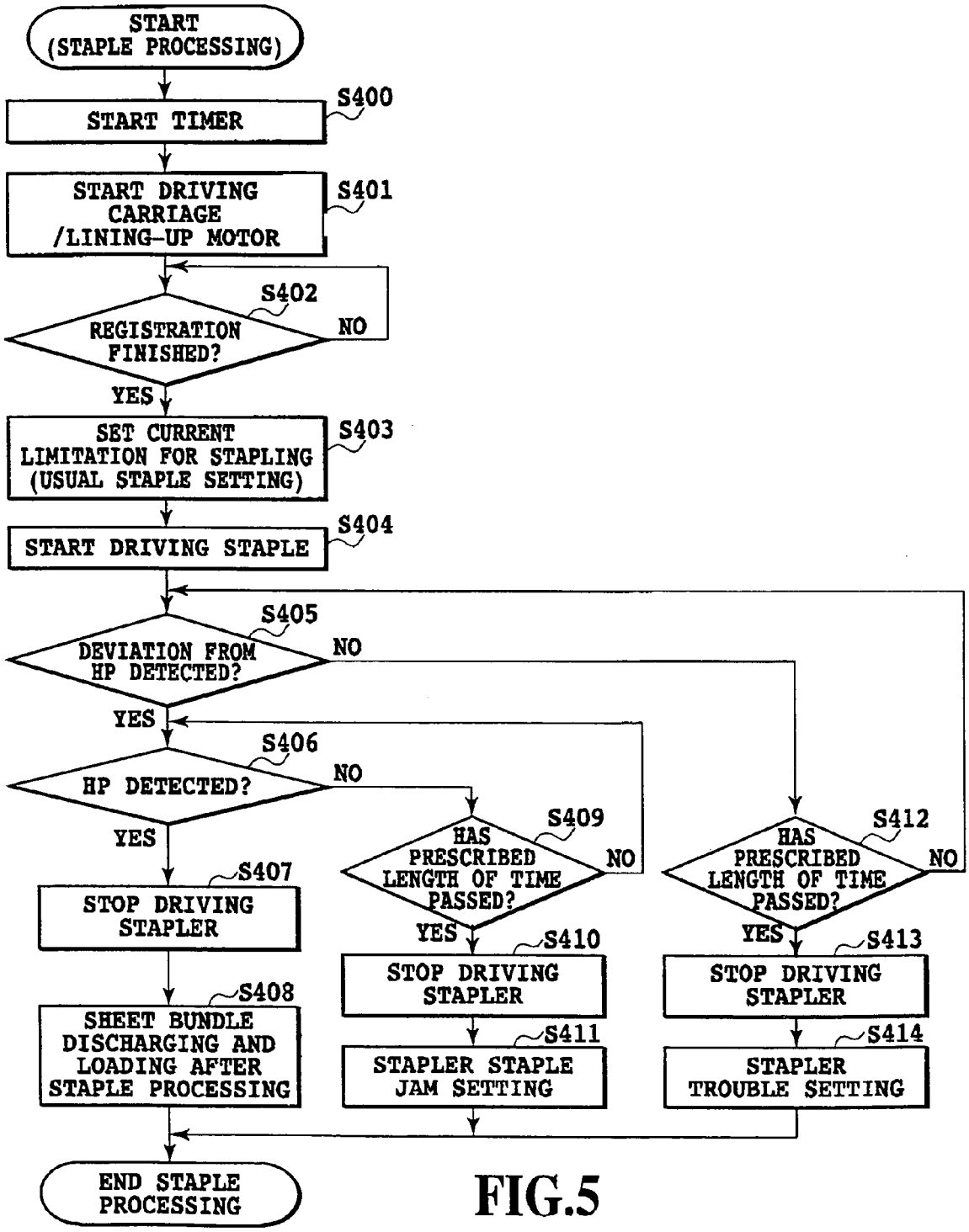
FIG. 5 is a flow chart showing staple processing by the post-processing device.

FIG. 5 is a flowchart showing post-processing operation in the post-processing device 100 connected to the image formation device 110.

At step S400, a timer for time monitoring is started immediately after the start of staple processing.

At step S401, the driving of the carriage motor 305 and the registration motor 309 is started. A sheet 106 on which an image is formed is received from the image formation device 100. When the sheet 106 is carried within the post-processing device 100, the left and right registration members 104L and 104R are driven for performing a registration process of the sheet 106 prior to staple post-processing.

At step S402, it is judged whether or not registration processing by moving the left and right registration members 104L and 104R has been completed. If completed, the process advances to step S403.

At step S403, current limitation for stapling is set. In this current limitation setting, the CPU 301*a* reads a current limitation value for stapling from the ROM 301*b* of the finisher control section 301, and the stapler driving circuit 313 sets the upper limitation of the stapler driving current in the current limitation circuit 314.

The current limitation setting for stapling is performed by limiting the driving current for the stapler motor 317 so that the current value detected by the current detecting/limitation circuit 314 of FIG. 3 is held at or below the level set by the CPU 301*a*. As one example of current limitation, the current detecting/limitation circuit 314 controls the driving voltage so as to set ON or OFF state, and controls the detected current value so as to be equal to or less than the limitation value. In this current limitation setting, the value read out of the ROM 301*b* is held in a predetermined area of the RAM 301*c* as a current limitation setting value.

Figure 6:
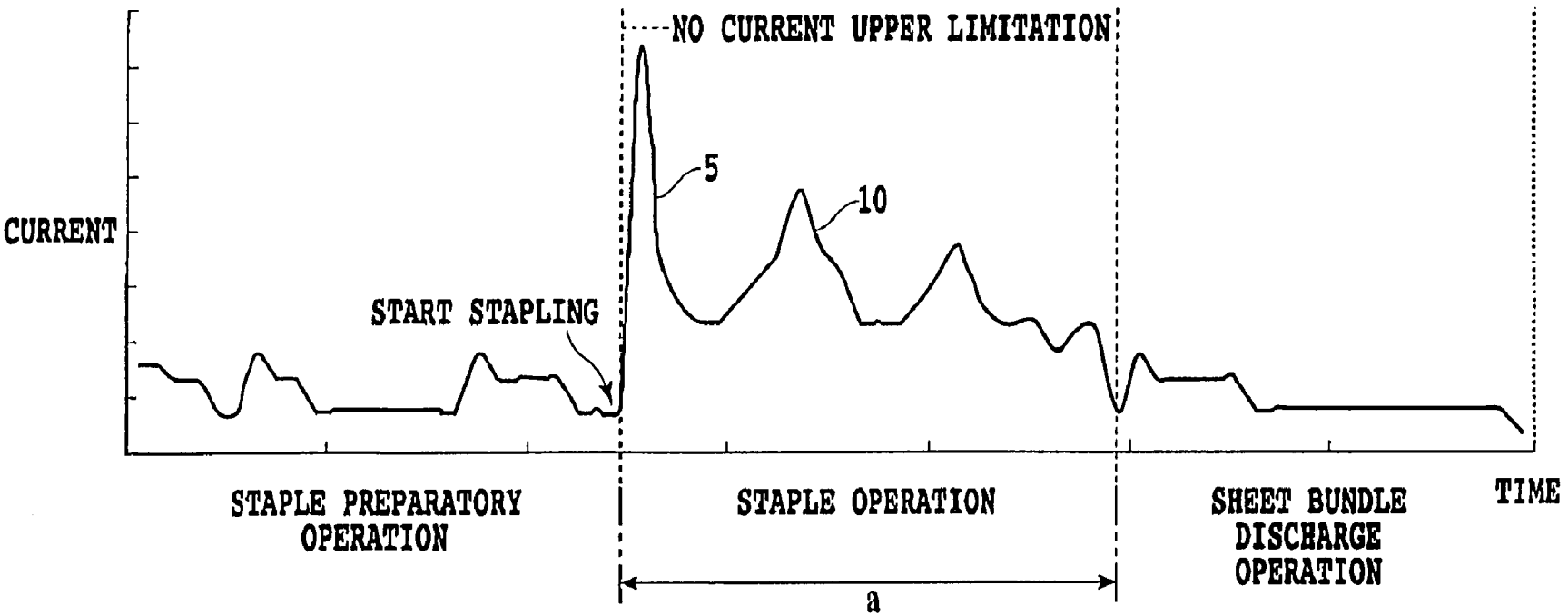
FIG. 6 is a timing chart showing processing without current limitation setting for the driving current in staple processing.
Figure 7:
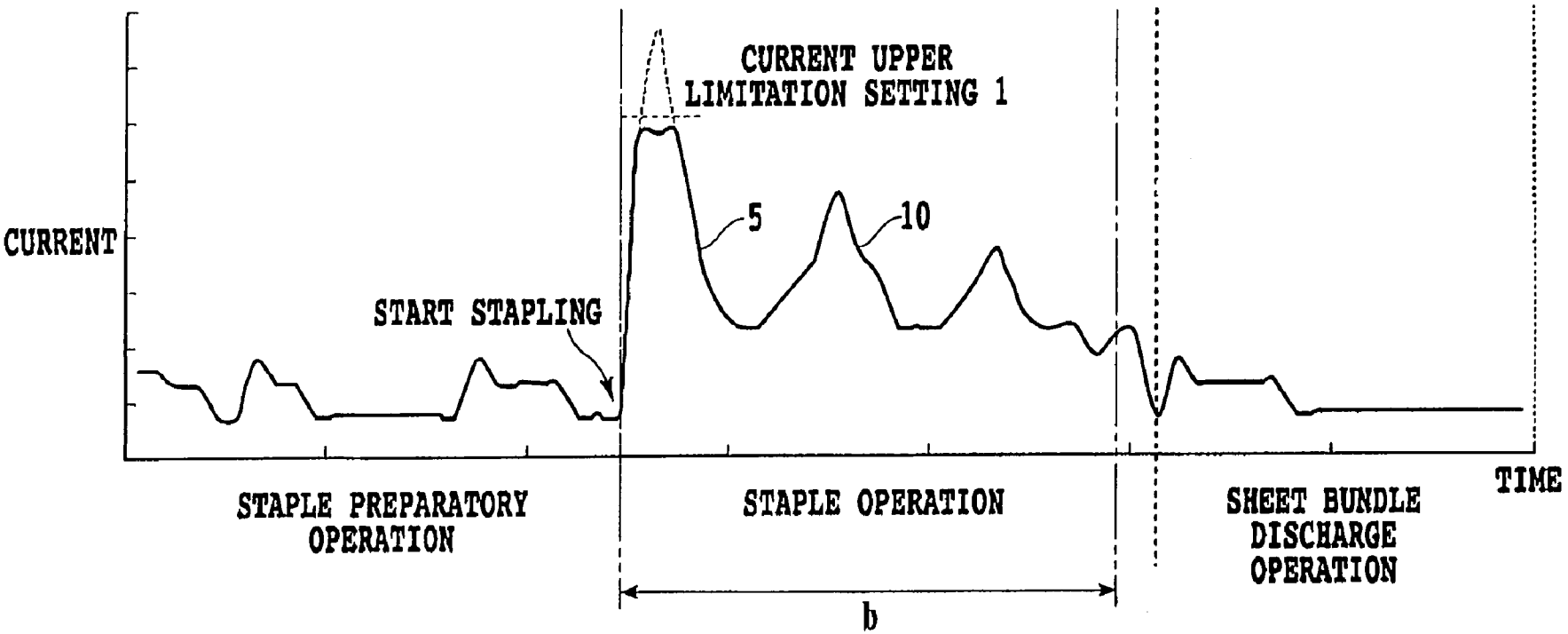
FIG. 7 is a timing chart showing processing with current limitation setting for the driving current immediately after the start of operation in staple processing.

Before the current limitation setting for stapling, as shown in FIG. 6, there is no limitation to the driving current 10 immediately after the driving of the stapler is started. However, after the current limitation is set, as shown in FIG. 7, the driving current 10 is controlled so as to be equal to or less than a prescribed level (=current upper limitation setting 1).

Here, the current value during stapling operation will be explained. In FIG. 6, a reference number 5 denotes the waveform of a current value immediately after the stapling operation is started, manifesting the waveform of the rush current arising immediately after the driving of the motor is started. A reference numeral 10 denotes the subsequent waveform of a current value at the time staples are pierced by the stapler 315 into sheets and bent.

At step S404, the driving of the stapler motor 317, which is the actuator of the stapler 315 for staple processing is started. Where the actuator to drive the stapler 315 is a motor, the rush current 5 immediately after the start of driving the motor is limited, but the driving current 10 driving the stapler motor 317 during the period that the stapler 315 pierces staples through the sheets and bends them is subject to no limitation.

Where the stapler motor 317 is a DC motor and a constant voltage is applied to the motor, by limiting the driving current 5, conceivably the time required for the stapling operation may be somewhat longer than the time where there is no current limitation. Thus, staple processing can be performed without problem in function or performance even if the duration of stapling operation is extended.

It is also possible to apply limitation to the current limitation value of the rush current 5 during the predetermined period immediately after the aforementioned start of driving and to the driving current 10 during another subsequent predetermined period. The current limitation value in this case can be performed by holding a plurality of upper limits in the ROM 301*b*, and the CPU 301*a* reads out a plurality of upper limitations and sets them in the stapler driving circuit 313.

Figure 8:
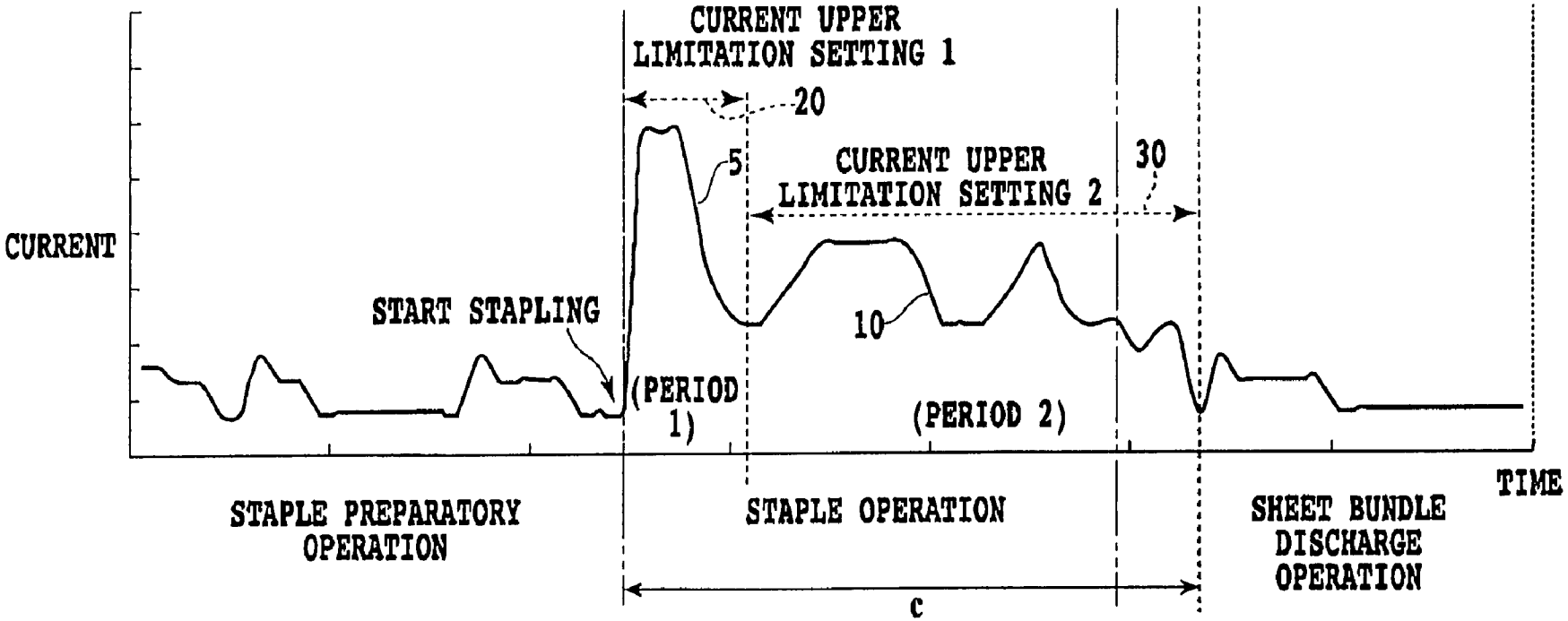
FIG. 8 is a timing chart showing processing with a plurality of current limitation settings for the driving current after the start of operation in staple processing.

FIG. 8 illustrates a case in which a plurality of upper limits of current are to be set, shown divided into a current rush period immediately after starting and subsequent periods.

The period of stapler driving can be divided into a current rush period 20 immediately after starting and subsequent periods 30, such as a plurality of prescribed periods including a period that staples pierce sheets and a period that staples are bent. By holding numerically a current upper limitation setting 1 for the rush current 5 in the current rush period 20 and a current upper limitation setting 2 for the driving current 10 in the subsequent periods 30 as the current upper limitation values in the ROM 301*b*, the CPU 301 sets those held current upper limitation values in the stapler driving circuit 313 immediately before driving the stapler 315.

(Step S403)

Incidentally, as is seen from comparison of FIG. 6, FIG. 7 and FIG. 8, the duration of stapling operation in the case of FIG. 7 is longer than that of FIG. 6, and the duration of stapler driving in the case of FIG. 8 is longer than that of FIG. 7 (a relationship in the duration of stapling operation; a<b<c). This indicates that a longer time is spent on stapler driving where one upper limitation is set (FIG. 7) or a plurality of upper limitations are set (FIG. 8) than where no upper limitation is set for the driving current (FIG. 6). In other words, the operating noise generated at the time of stapling in the cases of FIG. 7 and FIG. 8 is smaller than that of FIG. 6.

At step S405, after the start of stapler driving at step S404, the stapler HP sensor 318 and an HP detecting circuit 315 check whether or not the deviation of the driving member of the stapler 315 from the stapler HP, the reference position has been detected.

And if the deviation from HP has been detected, the process will advance to step S406. If no deviation from HP can be detected, the process will advance to step S412.

At step S412, it is judged whether or not a predetermined time has passed from immediately after the start of stapler driving until the detection of the deviation of the stapler HP sensor 318 from HP and, if it has not, the process will return to step S405.

If staple processing has finished, HP detection is judged at step S406 in order to detect HP again.

And if HP has been detected, the process advances to step S407 to stop driving the stapler 315. Then, at step S408, processing of sheet bundle discharging and loading after staple processing is performed by driving the carriage motor 305 and the registration motor 309.

At step S409, if the stapler HP was not detected at step S406, the timer is started, and it is judged whether or not a predetermined time has passed after the timer was started. If it has not, the process returns to step S406.

If the predetermined time has passed, the possibility of staple jamming in the stapler 315 becomes high. Then, the driving of the stapler 315 is stopped at step S410, stapler staple jam setting is performed at step S411, and interruption of printing or processing to switch over the sheet outlet is carried out on the printer section 302 via the communication I/F circuit 303 to stop delivery of sheets into the post-processing device 100.

Here, the stapler staple jam setting means that setting is performed so that a status signal indicating the occurrence of staple jamming is transmitted from the controller 300 to the printer controller section 302, and the printer controller section 302 transmits the received status signal to a display section (not shown) to display a message indicating the occurrence of staple jamming.

At step S412, if the deviation from the stapler HP cannot be detected in the predetermined time after the start of stapling at step S404, the driving of the stapler is stopped at step S413, and stapler trouble setting is performed at step S414 to indicate impossibility of normal driving.

Here, the stapler trouble setting means that setting is performed so that a status signal indicating the occurrence of stapler trouble is transmitted from the controller 300 to the printer controller section 302, and the printer controller section 302 transmits the received status signal to the display section (not shown) to display a message indicating the occurrence of stapler trouble.

Further, as in the stapler staple jam setting, interruption of printing or processing to switch over the sheet outlet is carried out on the printer section 302 via the communication I/F circuit 303 to stop delivery of sheets into the post-processing device 100.

In this example, when the post-processing device 100 detects any stapler trouble, the unit in trouble is supposed to be replaced, making recovery processing unnecessary. However, as another broad aspect of the present invention is not limited itself to replacement in this example.

As described processing above, any one of states, such as the state that the driving current of the stapler is limited to make normal stapling executable, another state that stapler staple jamming has occurred, and still another state that stapler trouble has occurred, can be performed.

The control of the conventional device discloses a process that the peak timings of driving currents (5 and 10) are changed. This conventional process is not to reduce the peak current of the actuator (stapler motor or the like) for action members, and thus it is difficult to reduce the operating sounds of individual units. However, according to the invention, the peak level of the current during the operation of the actuator can be reduced, and the operating speed of post-processing action members can be slowed down, thereby making possible reductions in the operating sounds generated by the contact and collision between action members during stapling operation at the time of post-processing operation.

An example of stapling operation is described as one of the examples of post-processing according to one embodiment of the present invention, other operations, such as book binding operations including punching operation and sheet bundle bending operation can perform the registration of limiting the current value, thus obtaining the same advantageous result.

EXAMPLE 2

A second preferred embodiment according to the present invention will be described with reference to FIG. 9 and FIG. 10. Incidentally, description of the same parts as their counterparts in the first embodiment described above will be dispensed with, and these parts will be denoted by respectively by the same reference signs.

This embodiment is an example in which the stapler 315 of the post-processing device 100 recovers from a state of staple jam setting (the state of S411 in the flow chart of FIG. 5), which is an abnormal state.

Figure 9:
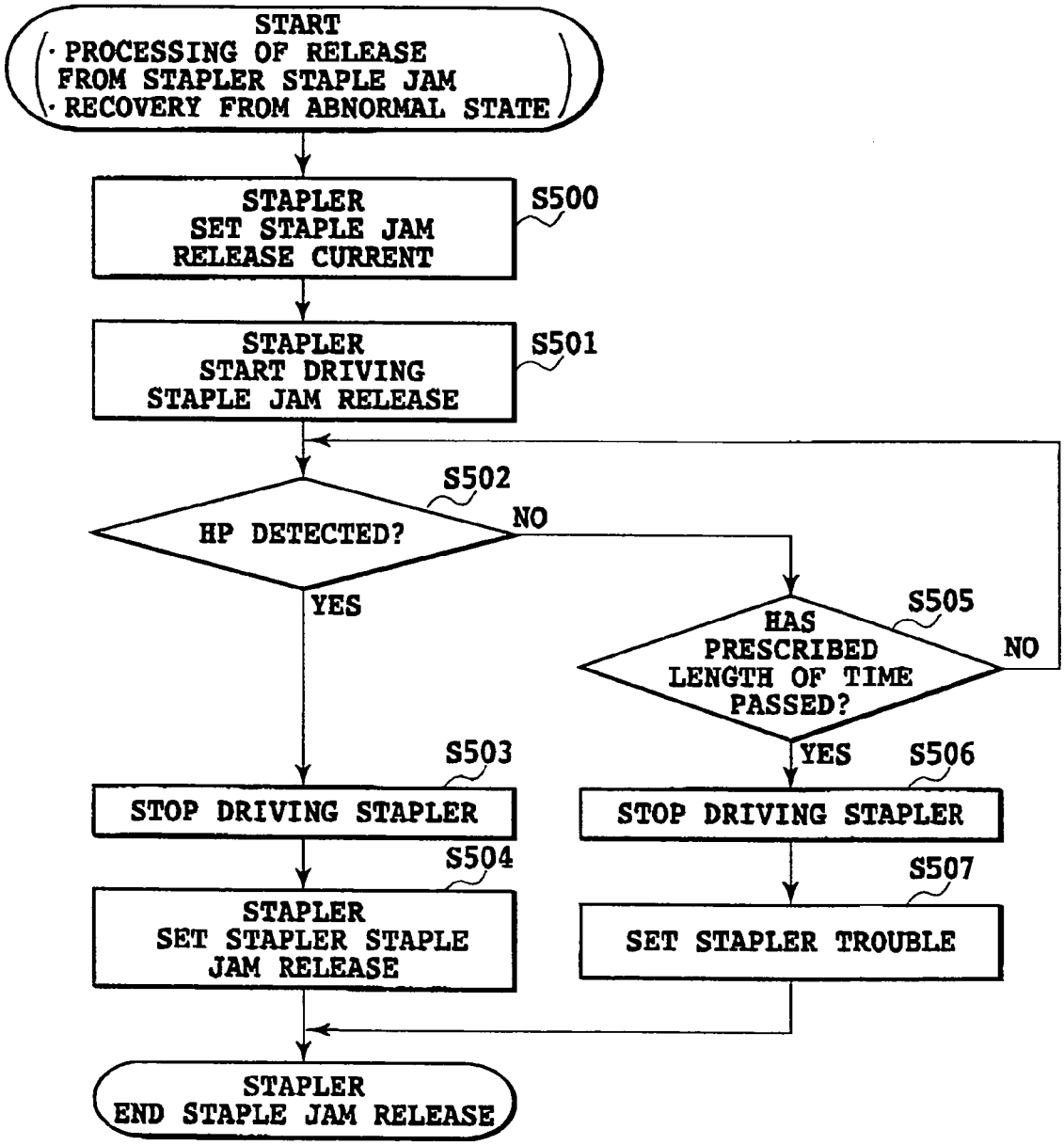
FIG. 9 is a flow chart showing recovery processing from a state of release from staple jamming as a second embodiment according to the present invention.

FIG. 9 is a flow chart showing processing to recover from a state of release from staple jamming as an example of recovery from an abnormal state.

When recovery processing starts, at step S500, the driving currents 5 and 10 at the time of release from stapler staple jamming are set.

The setting of the driving currents 5 and 10, like the above-described setting of the current in the period immediately following the start of post-processing operation, the CPU 301*a* reads a current limitation value for stapling from the ROM 301*b* of the finisher control section 301, and the stapler driving circuit 313 sets the upper limitation of the driving current 5 and 10 for the stapler 315 in the current limiting circuit 314.

Figure 10:
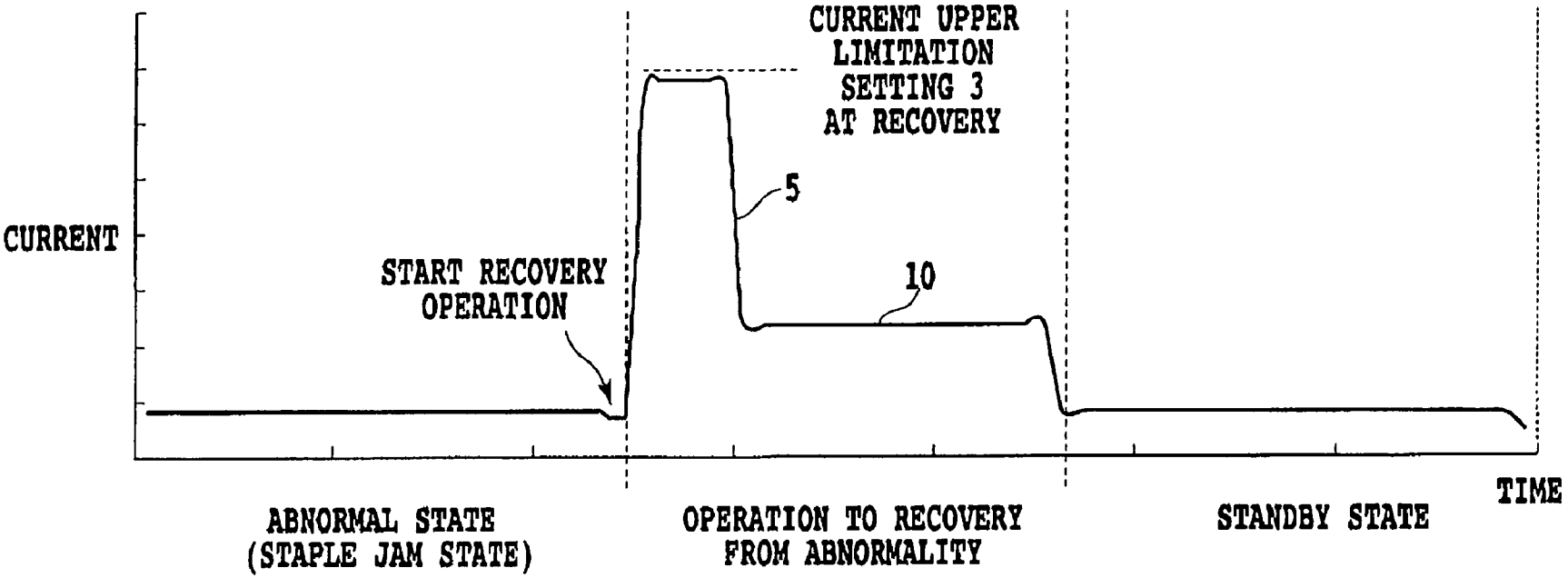
FIG. 10 is a timing chart showing an example of recovery operation to return, from an abnormal state of release from staple jamming.

FIG. 10 shows an example of control of recovery operation from an abnormal state of release from staple jamming.

Current limitation until the staple jamming state becomes is set immediately after the start of driving and subsequent periods as shown in FIG. 7 or FIG. 8 described above. Prior to performing a recovery operation from staple jamming, current upper limitation setting 3 at recovery is performed as the setting of the driving currents 5 and 10 at release from the staple jamming. Then, as shown in FIG. 10, in current limitation at recovery immediately after the start of recovery operation to recover from the staple jamming state, the driving currents 5 and 10 is controlled so as to be equal to or less than a predetermined value (=the current upper limitation setting 3 at recovery).

However, it is an effective way to set the values of the driving currents 5 and 10 at the time of release from stapler staple jamming higher than the set normal values because the burden of driving is heavier than in usual stapling in a normal state. In this case, the current value of the current upper limitation setting 3 at recovery is set higher than the current value of the current upper limitation setting at the time of stapling operation shown in FIG. 7 or FIG. 8. Concretely, a current value is set about 1.5 times higher than the current upper limitation setting 1. This reason is that the operation of release from staple jamming means that a forcible action to recover the stapler to HP (Home Position) from a state that staple jamming has occurred and thus a heavier burden than the usual stapling operation may be required.

At step S501, stapler driving for release from stapler staple jamming of the stapler is started. This driving for release from staple jamming of this example is a release method that the stapler motor 317 is driven in the direction reverse to the direction of stapling and the stapler is forced to recover the HP. However, the release method is not limited to the above method but some other method, such as a method that a special motor for releasing from staple jamming is provided and the motor performs release operation.

At step S502, it is judged whether or not the stapler HP is detected after the start of driving for release from stapler staple jamming. If it is detected, the process advances to step S503. If not detected, the process advances to step S505, where it is judged whether or not a predetermined time has passed after the driving of the stapler 315 is started.

At step S503, driving of the stapler 315 is stopped after detecting the stapler HP, and release from stapler staple jamming is set at step S504.

At step S504, a status signal indicating the occurrence of staple jamming is transmitted to the printer controller section 302 via the communication circuit 303. Further, the user is notified in order to release from staple jamming, by displaying a message on the display unit (not shown) provided on the image formation device or otherwise, so as to perform a process for removing any staple having failed.

If at step S505 it is judged that the predetermined time has not passed, the process returns to step S502. If the predetermined time has passed, the driving of the stapler 315 is stopped and stapler trouble is performed, with the result that the stapler HP is not detected from the state of staple jamming, which is an abnormal state at step S506, and recovery to a normal state is not succeeded.

Next, a process for altering current limitation setting for the driving current of the stapler 315 will be described with reference to FIG. 11.

Figure 11:
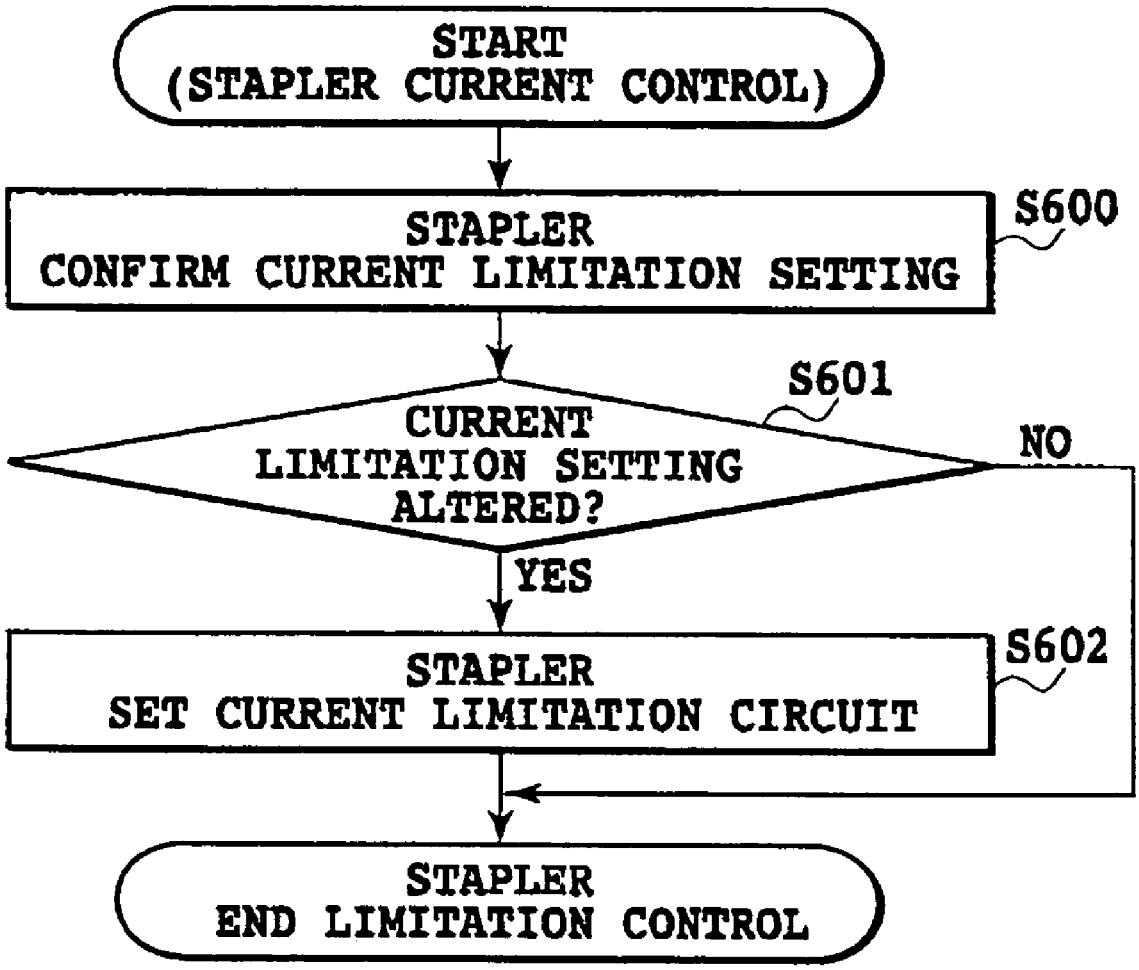
FIG. 11 is a flow chart showing a process that setting in the stapler driving circuit is altered after confirming current limitation setting for driving currents as a third embodiment according to the present invention.

FIG. 11 shows an example of method that the finisher control unit 301 confirms current limitation setting for the driving currents 5 and 10 of the stapler 315 and alters the contents of the current limitation setting.

The operation to alter the current limitation setting is performed when the setting at the time of stapling operation described with respect to Example 1 is changed to setting for release from staple jamming described with respect to this embodiment.

FIG. 11 is a flow chart of altering the contents of the current limitation setting in the stapler driving circuit 313 after confirming current limitation setting for the driving currents 5 and 10. However, this processing is performed in the finisher control section 301, and for instance, in parallel with the execution of the stapling operation control showing the flow chart of FIG. 5 described with respect to Example 1. This processing means that current limitation is performed at the time of driving the stapler 315.

At step S600, the current limitation setting for the stapler 315 is confirmed.

At step S601, if indication is produced so as to set anew or alter current limitation setting, the stapler driving circuit 313 at step S602 sets the current limiting circuit according to the set content (setting and altering are indicated by the finisher control section 301).

Here, concrete description of the confirmation, alteration and creation of current limitation setting will be explained.

Confirmation of stapler current limitation setting is performed by the CPU 301*a* of the finisher control section 301 during the operation of the post-processing device 100. For instance the CPU 301*a* performs confirmation processing at predetermined intervals of time between other processings to obtain the latest current limitation setting memorized in a predetermined area of the RAM 301*c*.

In the case of setting newly current limitation setting, this current limitation setting for this staple can be performed by setting the upper limitation of driving current during a predetermined initial period immediately after the start of stapling operation and by setting the upper limitations of a plurality of driving currents during a plurality of predetermined periods including other periods.

Setting for the current limitation circuit is performed by, from the CPU 301*a* to the stapler driving circuit 313, setting information such as a signal line or transmitting communication data. The stapler driving circuit 313 selects a predetermined limitation circuit among current limitation circuits included in the current limiting circuit 314*a* in FIG. 4 based on the set current limitation circuit.

In this example of FIG. 4, either the current limitation circuit (1) 314*c* or the current limitation circuit (2) 314*d* is selected. The current limitation circuit 314*a* detects the current value at the time of driving the stapler motor 317 via the current detecting circuit 314*b*, and forces the stapler driving circuit 313 to perform current limitation. This current limitation can be performed by any method including the control of the current limitation, such as turning ON or OFF power supply to the stapler driving circuit 313.

Concretely, in order to alleviate the burden on the power source and to reduce the noise of operation, the current limitation circuit 1 is selected so as to set the current upper limitation setting 1 at the time of stapling operation described with respect to Example 1, and the current limitation circuit 2 is selected so as to set the current upper limitation setting 3 when driving to recover from staple jamming is performed in order that driving power is required by the stapler more than in stapling and yet the current limitation is performed.

EXAMPLE 3

A third preferred embodiment according to the present invention will be described with reference to FIG. 12. Incidentally, description of the same parts as their counterparts in Example 1 described above will be dispensed with, and these parts will be denoted by respectively by the same reference signs.

This embodiment is an example in which current limitation is set while the stapler 315 is being driven.

Figure 12:
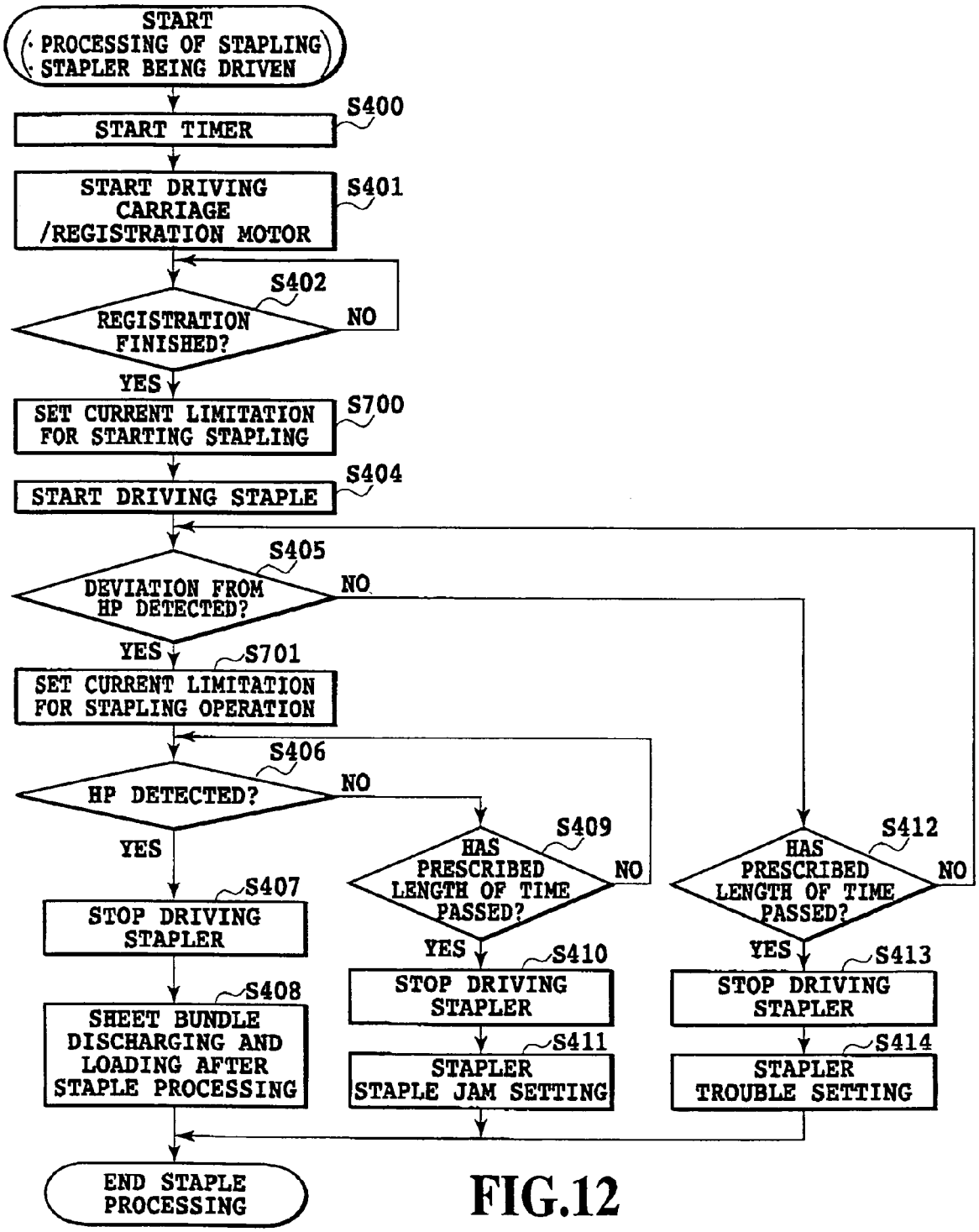
FIG. 12 is a flow chart showing setting current limitation during the driving operation of the stapler as a fourth embodiment according to the present invention.

FIG. 12 is a flow chart showing processing for setting current limitation while the operation of the stapler 315 is being driven.

At step S400, the timer for time monitoring is started immediately after the start of staple processing.

At step S401, the driving of the carriage motor 305 and the registration motor 309 is started, sheets on which an image is formed are received from the image formation device 110 and are carried within the post-processing device 100, and the left and right registration members 104L and 104R are driven to perform registration processing of the sheets before staple post-processing.

At step S402, it is judged whether or not registration processing by the moving of the left and right registration members 104L and 104R has been finished. If finished, the process advances to step S700.

At step S700, current limitation setting for the start of the stapler 315 is performed. In this current limitation setting, the CPU 301*a* reads out the upper limitation as the limitation value of the driving current 10 from the ROM 301*b* of the finisher control section 301 so as to limit the rush current 5 to the stapler motor 317 at the time of stapling. The stapler driving circuit 313 sets the upper limitations of the driving currents 5 and 10 of the stapler 315 in the current limiting circuit 314.

At step S404, the driving of the stapler motor 317, which is the actuator of the stapler 315 that forces sheets to perform staple processing, is started.

At step S405, after starting driving of the stapler at step S404, it is confirmed that whether or not the deviation of the driving member of the stapler 315 from the stapler HP as the reference position is detected based on the output from the stapler HP sensor 318 and the stapler HP detecting circuit 315. If the deviation from the stapler HP is detected, the process advances to step S701.

At step S701, setting value of the current limitation, from the time of detection of the deviation from the stapler HP due to the stapler HP sensor 318, is altered so as to make the limitation of the driving currents 5 and 10 of the stapler 315 the upper limitation during operation.

For instance, if the rush current 5 immediately after the start of driving the stapler 315 is greater than the driving current 10 during stapling operation, two different current limitations can be set, and thus the current limitation immediately after the start of driving can be set higher than the driving current limitation during operation.

That is, as shown in FIG. 8 described above, the current limitation (current upper limitation setting 1) is set higher immediately after the start of driving the stapler and later, after the deviation from the stapler HP is detected, control is performed so as to switch the set current limitation to a lower current limitation (current upper limitation setting 2).

The current limitation setting while the stapler 315 is operating is the upper limitation of the current upper limitation setting 2, shown as a period 30 in FIG. 8. The current value at the operating is equal to the minimum current value required for letting stapes pierce sheets or for bending the tip of the staples when the stapler 315 staples sheet bundle, and is equal to the current value according to a stapler specification, but is not limited to any special value.

The current value of this current upper limitation setting 2 can be altered appropriately depending on the condition of the sheet bundle to be stapled by the stapler 315 at the driving current during operating, and is set, for instance, the current value can be altered similarly when the current value is equal to or higher than the current value immediately after the start.

As an example, if the number of sheets to be stapled is up to 10, setting period (30) of FIG. 8 is set to the current upper limit setting 2. If the number is 11 or more, setting of period (30) of FIG. 8 is set to the current upper limitation setting 1.

Next, when staple processing is finished, HP detection is judged at step S406 in order to detect the HP again.

And if the HP is detected, the process advances to step S407 to stop the driving of the stapler, and at step S408, the discharging processing of the sheet bundle and the loading processing after staple processing are performed by driving the carriage motor 305 and the registration motor 309.

At step S409, if the stapler HP is not detected at step S406, and it is judged whether or not a predetermined time is passed after the timer is started.

If the predetermined time is not passed, the process returns to step S406. If the predetermined of time is passed, since the possibility of the occurrence of the staple jamming in the stapler 315 is high, the process advances to step S410.

At step S410, the driving of the stapler 315 is stopped. At step S411, staple jam setting of the stapler 315 is performed, and the control of interruption of printing or processing to switch over the sheet outlet is performed in the printer section 302 via the communication I/F circuit 303 to stop delivery of sheets into the post-processing device 100.

At step S412, if the deviation from the stapler HP cannot be detected within the predetermined time after the start of stapling at step S404, the driving of the stapler 315 is stopped at step S413, and trouble setting of the stapler 315 is performed at step S414 to indicate impossibility of normal driving.

Further, as in the staple jam setting of the stapler 315, interruption of printing or processing to switch over the sheet outlet is performed on the printer section 302 via the communication I/F circuit 303 to stop delivery of sheets into the post-processing device 100. In this example, in the case of detection of any stapler trouble by the post-processing device 100, the unit in trouble is supposed to be replaced, making recovering processing unnecessary, but the present invention is not limited to this replacement.

As mentioned the processing above, the state immediately after the driving of the stapler 315 or the state during stapling operation is determined based on the detection state of stapler HP. Thus, the stapling operation is divided into a plurality of periods and the upper limitation of the driving current can be set in each divided period to perform limitation processing, thereby reducing the current value during post-processing in the post-processing device 100.

Description of staple jam setting and trouble setting of the stapler 315 will be dispensed with because they are the same as in Example 1.

Further, by limiting the current during post-processing operation, the speed of stapling operation by processing members is reduced. As a result, the noise of operation of post-processing members can be reduced, thus keeping post-processing noiseless.

EXAMPLE 4

A fourth preferred embodiment according to the present invention will be described with reference to FIG. 13. Incidentally, description of the same parts as their counterparts in Example 1 described above will be dispensed with, and these parts will be denoted by respectively by the same reference signs.

This embodiment is an example in which the operating states of other devices (within the image formation system) connected to the post-processing device 100 and the image formation device 110 are confirmed and the current limitation values are set.

Here, other devices include, for instance, a scanner unit for reading subject copies and a large capacity paper feed deck to be connected to the image formation device.

In a configuration in which a plurality of devices including a post-processing device, a scanner unit and a paper feed deck are connected to the image formation device and a power source provided in the image formation device supplies electric power to the plurality of devices, the total power consumption required for operating the plurality of devices at the same time may surpass the supplicable power because the power supplied from the power source is limited. In this example, the current limitation of the post-processing devices is set based on the operating states of other devices connected to the image formation device (i.e. other than the post-processing device), and the optimal setting for the current value is performed within the supplicable power from the power source.

Figure 13:
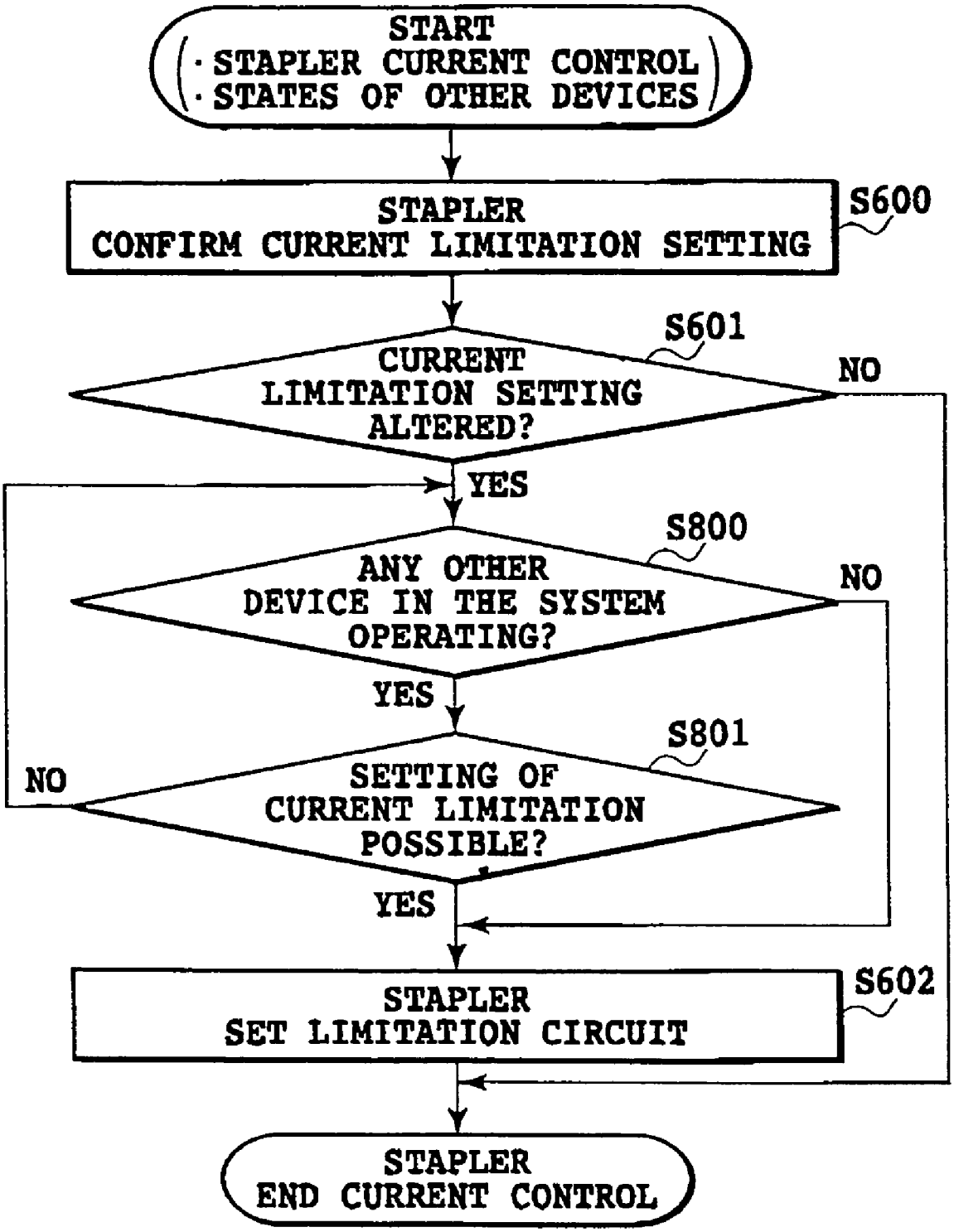
FIG. 13 is a flow chart showing a process that a current limit is set in the stapler driving circuit after confirming the operating states of other devices as a fifth embodiment according to the present invention.

FIG. 13 is a flow chart showing a case in which a current limitation is set in the stapler driving circuit 313 after confirming the operating states of other devices. This processing is a case in which determination processing to confirm the operating states of other devices connected to the image formation device 110 and the post-processing device 100 and to set the current limitation is added to the stapler current limitation processing shown in the flow chart of FIG. 11 described above. Incidentally, this processing is regularly performed by the finisher control section 301 and thus the current limitation is performed when driving the stapler 315.

Here, the operation to confirm the operating states of other devices means, for instance, an operation that whether or not a scanner unit is reading a subject copy. If it is, the current limitation is performed when the stapler 315 is driven.

At step S600, the current limitation setting of the stapler 315 is confirmed.

At step S601, it is judged whether or not indication is produced so as to set anew or alter current limitation setting (setting and altering is indicated by the finisher control section 301).

If it is judged that the setting is altered, it will be judged at step S800 whether or not any other device in the image formation system is operating.

In the judgment, the finisher control section 301 demands data representing the operating state of the other device (not shown) from the printer section 302 via the communication I/F circuit 303.

If any other device or devices are operating, at step S801, the predetermined upper limitation of current limitation during post-processing operation is read out of the ROM 301*b* based on the required current value of each operating device or the specification of the current value of (i.e. the suppliable current value) the power source 312, and it is judged whether or not a current upper limitation can be set.

If the total required current value surpasses the specification of the current value of the power source 312 when a plurality of devices are operating, the process returns to step S800, and the operating states of other devices are confirmed. Similarly at step S801, it is judged whether or not current limitation setting is possible.

And if post-processing operation is possible at the current limitation setting, the process advances to step S602, and circuit selection for limiting the current of the stapler driving circuit 313 is set.

This circuit selection for current limitation is a process that the CPU 301 selects a predetermined circuit from the current limitation circuits 314*c* and 314*d* of the current limiting circuit 314*a* shown in FIG. 4 so that the sum of the total current consumption of the plurality of other devices connected to the power source 312 and the settable current value for driving the stapler is lower than the upper limitation of the current value of the power source 312. The current consumption of the plurality of other devices is received and recognized as a data signal representing the operating states of the other devices via the communication I/F circuit 303.

As described above, the operating states of all the devices (the image formation system) connected to the post-processing device 100 and the image formation device 110 can be confirmed and the current limitation for stapling by the post-processing device 100 can be set, and thus performing optimal current limitation during post-processing according to the operating state of the whole system.

In the above embodiments according to the present invention, a configuration in which electric power is supplied from a power source provided in the image formation device to the post-processing device connected to the image formation device, a different configuration in which each of the image formation device and the post-processing device is equipped with a power source can be applied to the present invention.

According to the invention, the operating state of post-processing is detected and the magnitude of drive signal is limited based on the result of detection during a predetermined period after the start of post-processing operation, an upper limitation is set to the drive signal such as the driving current and the peak value of the drive signal is limited and lowered and thus reducing the burden of the power source. Therefore, a compact and low-cost power source can be available as the power source for the post-processing device, obtaining the low-priced and the small-sized image processing system.

Also according to the present invention, the limitation period of peak value of the drive signal at post-processing operation can be divided into a plurality of periods including normal operation and recovery from an abnormal state and thus the drive signal is controlled in each divided period. Therefore, the peak value of the drive signal can be reduced according to the operating state of the post-processing section.

Further according to the present invention, the operating speed of the post-processing section is slowed down by lowering the peak value of the drive signal during post-processing operation, and thus the noise of operation of the post-processing action members can be reduced at the same time.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application Nos. 2003-435941 filed Dec. 26, 2003 and 2004-333299 filed Nov. 17, 2004, which are hereby incorporated by reference herein.

What is claimed is:

1. A post-processing device comprising:

sheet conveying means for carrying sheets outputted from an image formation device into a main body of the post-processing device;

post-processing means for subjecting a plurality of sheets carried into the main body to a staple processing operation as a sheet bundle;

drive signal limitation means for limiting, a value of a drive signal for driving said post-processing means during a predetermined period corresponding to an operating state of the staple processing operation by said post-processing means, after a start of the staple processing operation; and sheet bundle loading means for loading the staple-processed sheet bundle.

2. The post-processing device according to claim 1, wherein said drive signal limitation means sets a limitation value to limit the value of the drive signal during a predetermined period from immediately after the start of the staple processing operation.

3. The post-processing device according to claim 2, wherein the predetermined period from immediately after the start of said the staple processing operation is a period in which the value of the drive signal in the staple processing operation at the time of normal operation is limited.

4. The post-processing device according to claim 1, wherein said drive signal limitation means sets a different limitation value for limiting the value of the drive signal during a plurality of predetermined periods from immediately after the start of the staple processing operation.

5. The post-processing device according to claim 4, wherein a limitation value for limiting the value of the drive signal is set during a predetermined period of the staple processing operation after the lapse of the predetermined period from immediately after the start of the staple processing operation.

6. The post-processing device according to claim 1, wherein said drive signal limitation means sets a limitation value for limiting the value of the drive signal during a predetermined period from the start of operation after recovering from an abnormality of said post-processing means.

7. The post-processing device according to claim 1, wherein said drive signal limitation means sets a limitation value for limiting the value of the drive signal based on the operating state of another device connected to the image formation device.

8. The post-processing device according to claim 1, wherein said drive signal limitation means limits the value of the drive signal in each of a period that a home position as a reference position of staple processing operation is detected and a period that the home position is not detected.

9. The post-processing device according to claim 1, wherein the limitation of the value of the drive signal is the limitation of the upper limitation of a driving current.

10. An image formation system provided with an electrophotographic image formation device is featured in that the post-processing device according to claim 1 is connected to a stage following said image formation device.

11. A post-processing method comprising:

a sheet conveying step of carrying sheets outputted from an image formation device into a main body of a post-processing device;

a post-processing step of subjecting a plurality of sheets carried into the main body to staple processing as a sheet bundle;

a drive signal limitation step of limiting a value of a drive signal for driving said post-processing means during a predetermined period corresponding to an operating state of staple processing operation by said post-processing means, after a start of the staple processing operation; and a sheet bundle loading step of loading the staple-processed sheet bundle.

12. The post-processing method according to claim 11, wherein said drive signal limitation step sets a limitation value to limit the value of the drive signal during a predetermined period from immediately after the start of said staple processing operation.

13. The post-processing method according to claim 12, wherein the predetermined period from immediately after the start of said staple processing operation is a period in which the value of the drive signal in the staple processing operation at the time of normal operation is limited.

14. The post-processing method according to claim 11, wherein said drive signal limitation step sets a different limitation value for limiting the value of the drive signal during a plurality of predetermined periods from immediately after the start of said staple processing operation.

15. The post-processing method according to claim 14, wherein a limitation value for limiting the value of the drive signal is set during a predetermined period of staple processing operation after the lapse of the predetermined period from immediately after the start of said staple processing operation.

16. The post-processing method according to claim 11, wherein said drive signal limitation step sets a limitation value for limiting the value of the drive signal during a predetermined period from the start of operation after recovering from an abnormality of said post-processing means.

17. The post-processing method according to claim 11, wherein said drive signal limitation step sets a limitation value for limiting the value of the drive signal based on the operating state of another device connected to the image formation device.

18. The post-processing method according to claim 11, wherein said drive signal limitation step limits the value of the drive signal in each of a period that a home position as a reference position of staple processing operation is detected and a period that the home position is not detected.

19. The post-processing method according to claim 11, wherein the limitation of the value of the drive signal is the limitation of the upper limitation of driving current.

* * * * *

UNITED STATES PATENT AND TRADEMARK OFFICE

CERTIFICATE OF CORRECTION

PATENT NO. : 7,240,898 B2
APPLICATION NO. : 11/016860
DATED : July 10, 2007
INVENTOR(S) : Takamura et al.

It is certified that error appears in the above-identified patent and that said Letters Patent is hereby corrected as shown below:

ON THE TITLE PAGE:
Item (56), "08129287 A" should read --8-129287 A--.

COLUMN 1:
Line 19, "stocked" should read --stacked--.

COLUMN 2:
Line 1, "each other," should be deleted.
Line 5, "are" should read --is--.
Line 46, "provide" should read --provided--.

COLUMN 3:
Line 4, "electro photo-" should read --electrophoto- --.

COLUMN 4:
Line 43, "are" should read --is--.

COLUMN 9:
Line 21, "becomes" should read --occurs--.

COLUMN 10:
Line 14, "is not succeeded." should read --does not succeed--.

COLUMN 12:
Line 19, "stapes" should read --staples--.

COLUMN 13:
Line 26, "by" (first occurrence) should be deleted.
Line 42, "supplicable" should read --supplied--.
Line 48-49, "supplicable" should read --supplied--.
Line 63, "that" should read --to confirm--.

Signed and Sealed this

Sixteenth Day of February, 2010

David J. Kappos

David J. Kappos
*Director of the United States Patent and Trademark Office*